US010011392B2

(12) United States Patent
Viau

(10) Patent No.: US 10,011,392 B2
(45) Date of Patent: Jul. 3, 2018

(54) BACKPACK INSERT WITH POCKETS

(75) Inventor: Alice Rose Viau, Layton, UT (US)

(73) Assignee: BUZINESS EXPERTS, LLC, Layton, UT (US)

( * ) Notice: Subject to any disclaimer, the term of this patent is extended or adjusted under 35 U.S.C. 154(b) by 0 days.

(21) Appl. No.: 13/552,547

(22) Filed: Jul. 18, 2012

(65) Prior Publication Data

US 2013/0180992 A1 Jul. 18, 2013

Related U.S. Application Data

(60) Provisional application No. 61/508,697, filed on Jul. 18, 2011.

(51) Int. Cl.

| | |
|---|---|
| ***B65D 25/04*** | (2006.01) |
| ***A45C 13/02*** | (2006.01) |
| ***A45F 3/00*** | (2006.01) |
| *A45F 3/04* | (2006.01) |

(52) U.S. Cl.

CPC ..... *B65D 25/04* (2013.01); *A45C 13/02* (2013.01); *A45F 3/00* (2013.01); *A45C 2013/026* (2013.01); *A45F 3/042* (2013.01); *A45F 2003/001* (2013.01)

(58) Field of Classification Search

CPC ... B65D 25/04; A45C 13/02; A45C 2013/026; A45F 3/00; A45F 3/042

USPC ..... 190/110; 229/72

See application file for complete search history.

(56) References Cited

U.S. PATENT DOCUMENTS

| | | | | | |
|---|---|---|---|---|---|
| 314,598 | A | * | 3/1885 | Meek | 229/72 |
| 1,151,708 | A | * | 8/1915 | Neff | A41F 9/002 2/338 |
| 1,361,983 | A | * | 12/1920 | Greenwald | A41F 9/002 2/320 |
| 1,418,371 | A | * | 6/1922 | Foster | 224/182 |
| 1,552,303 | A | * | 9/1925 | Hubbard | 4/285 |
| 1,754,663 | A | * | 4/1930 | Adams | 190/115 |
| 2,171,676 | A | * | 9/1939 | Wallace | 2/48 |
| 2,452,096 | A | * | 10/1948 | Bertalotto | 150/140 |
| 2,558,382 | A | * | 6/1951 | Previdi | A63B 47/001 2/250 |
| 3,623,526 | A | * | 11/1971 | Robertson | 383/99 |
| 3,717,188 | A | * | 2/1973 | Green | B60R 7/088 206/387.15 |
| 4,821,933 | A | * | 4/1989 | Seber | A45F 5/02 224/248 |
| 4,901,899 | A | * | 2/1990 | Barrett | 224/223 |
| 4,953,765 | A | * | 9/1990 | Little et al. | 224/583 |
| 5,024,361 | A | * | 6/1991 | Flowers | 224/223 |
| 5,170,889 | A | * | 12/1992 | Cue | 206/232 |
| 5,228,609 | A | * | 7/1993 | Gregory | A45F 3/02 224/617 |
| 5,269,023 | A | * | 12/1993 | Ross | 2/66 |
| D352,260 | S | * | 11/1994 | Adamo | D12/133 |
| D355,070 | S | * | 2/1995 | Thiessen | D3/226 |
| 5,836,497 | A | * | 11/1998 | Pelish | 224/677 |

(Continued)

*Primary Examiner* — Tri Mai

(74) *Attorney, Agent, or Firm* — Jeffery M. Lillywhite, PC

(57) ABSTRACT

An insert for a backpack includes an inner pocket assembly having staggered pockets. The inner pocket assembly is attached to the back panel of the insert. Arms are attached to the sides of the insert. The arms are configured to wrap in front to the insert and connect to each other. Each pocket of the staggered pockets include an opening in the bottom corners.

7 Claims, 8 Drawing Sheets

(56) References Cited

U.S. PATENT DOCUMENTS

| | | | | |
|---|---|---|---|---|
| 6,619,519 | B1 * | 9/2003 | Nix | A45C 7/0086 224/153 |
| 6,962,278 | B2 * | 11/2005 | Obatake | 224/681 |
| D528,785 | S * | 9/2006 | Fraga | D3/228 |
| D549,959 | S * | 9/2007 | Wood | D3/228 |
| D662,132 | S * | 6/2012 | Smith et al. | D19/26 |
| 2002/0114539 | A1 | 8/2002 | Strevey et al. | |
| 2005/0121121 | A1 | 6/2005 | Wang | |
| 2005/0183758 | A1 | 8/2005 | Corbitt | |
| 2007/0075109 | A1 | 4/2007 | McCrae | |
| 2008/0017683 | A1 * | 1/2008 | Votel | 224/677 |

* cited by examiner

BACKPACK INSERT WITH POCKETS

CROSS-REFERENCE TO RELATED APPLICATIONS

This application claims priority to U.S. Provisional Application Ser. No. 61/508,697, filed on Jul. 18, 2011, and is incorporated herein by reference in its entirety.

BACKGROUND OF THE INVENTION

1. The Field of the Invention

The invention relates to backpacks, and in particular to inserts having pockets for backpacks.

2. The Relevant Technology

Backpacks are a popular device that people use to carry articles. Students, for example, use backpacks to carry books, papers, clothing and food. People also use backpacks for recreational activities. When these backpacks are loaded with heavy articles, such as text books, laptops or computer tablets, they tend to be weighted unevenly, which can hurt the user's back.

Backpacks are generally constructed of a rectangular shape having an interior compartment and a long peripheral zipper that allows access to the compartment. Items are transported by the user by placing items in the interior compartment. Shoulder straps are placed on one side of the backpack for people to carry it on their back. The backpack may also have a handle strap attached to the top of the bag to allow the user to grab the backpack with one hand to pick it up.

Pockets have been usually been placed on the backpack to store small items or to separate them from other articles stored in the pack. For example, outside pockets are provided to store items. Other examples include a backpack with a central compartment and outside pockets. The pockets are generally configured to hold a particular item, for example, an audio device or sports equipment. Some backpacks have been designed with wheels to reduce the strain on the user's back.

These previous backpacks, however, have not been constructed to carry heavy items in a position that reduces the torque applied to the user's body. They also do not allow the user to see the items stored within the backpack or assist the user wear a hip support. Accordingly, it would be desirable to provide an insert for a backpack which would facilitate a user carrying heavy objects.

BRIEF SUMMARY OF THE INVENTION

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

In one embodiment, an insert for a backpack includes an inner pocket assembly having staggered pockets. The inner pocket assembly is attached to the back panel of the insert. Arms are attached to the sides of the insert. The arms are configured to wrap in front to the insert and connect to each other. Each pocket of the staggered pockets include an opening in the bottom corners.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE VARIOUS EMBODIMENTS

Figure 1:
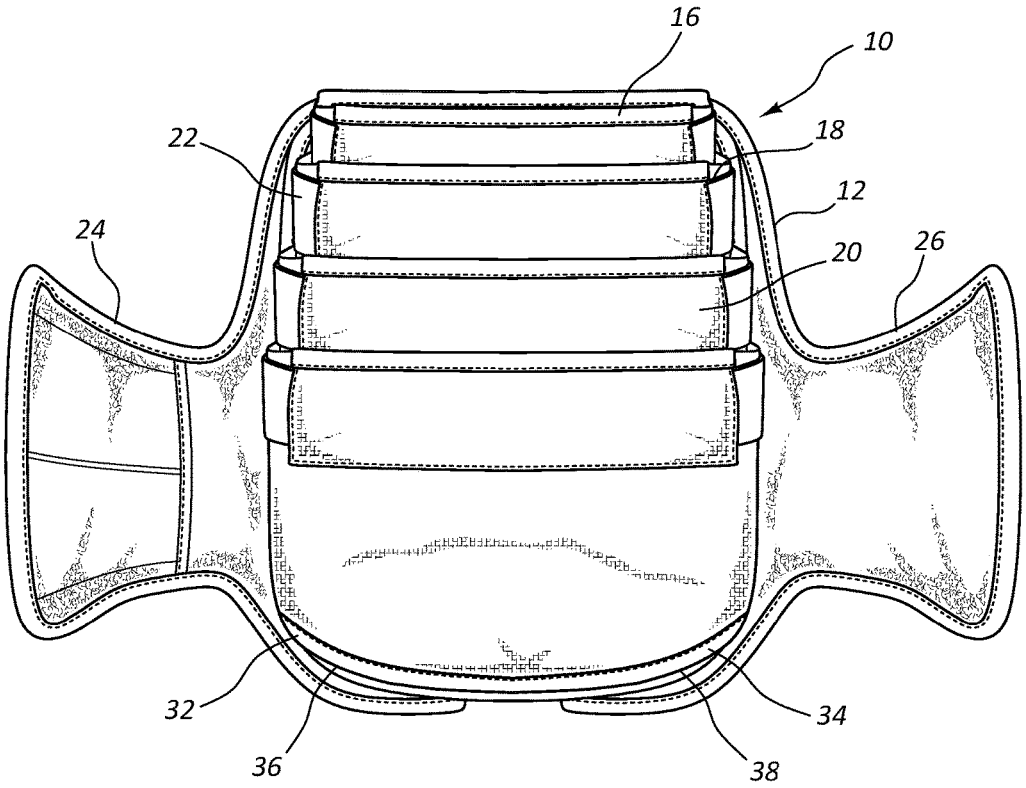
FIG. 1 illustrates a front view of one embodiment of an inert for a backpack in accordance with the present invention.
Figure 2:
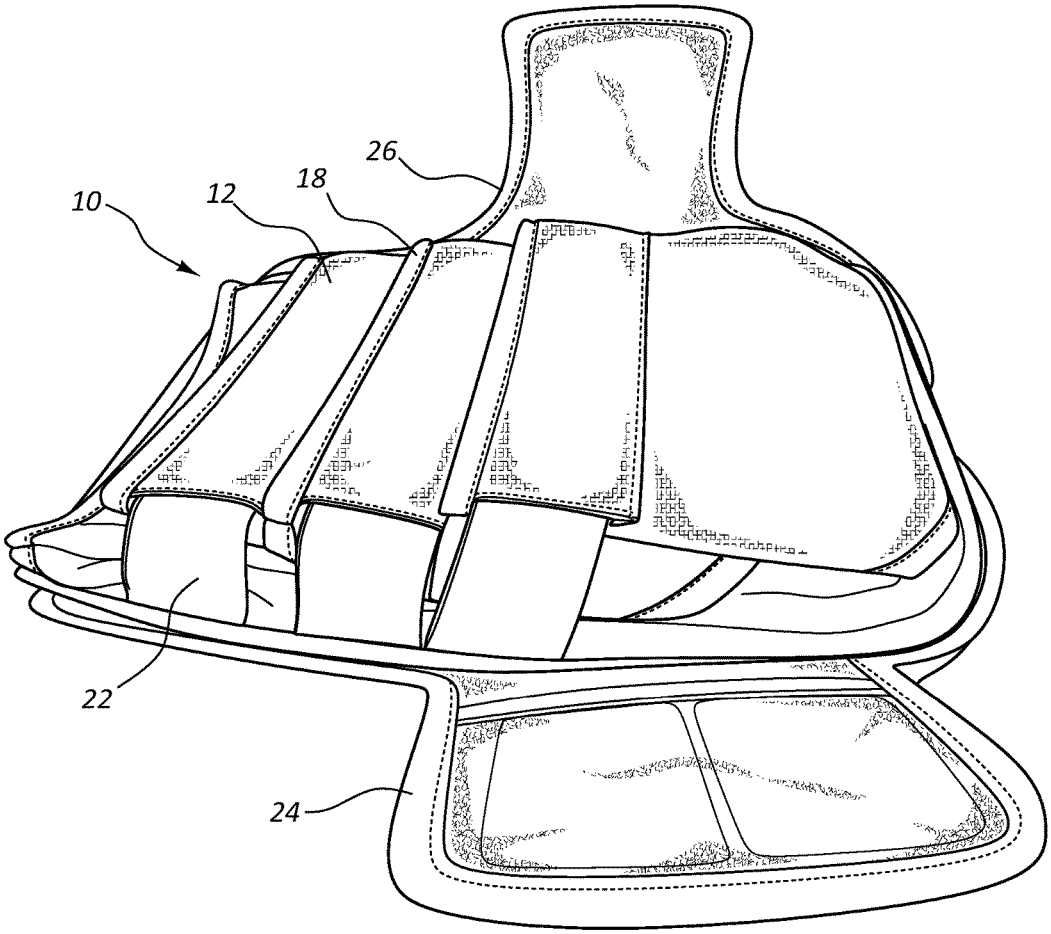
FIG. 2 illustrates a side view of the insert in FIG. 1.
Figure 3:
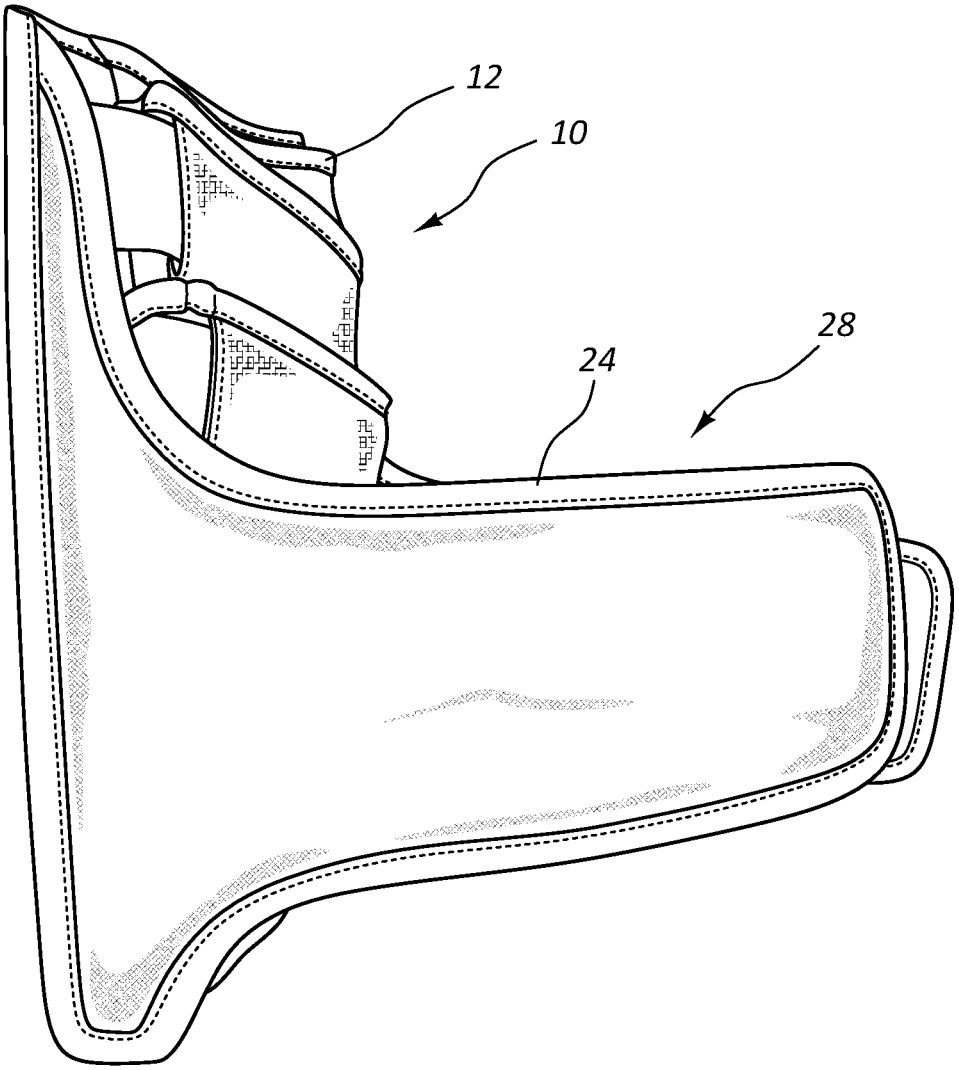
FIG. 3 illustrates a side view of the insert with the arms extended.
Figure 4:
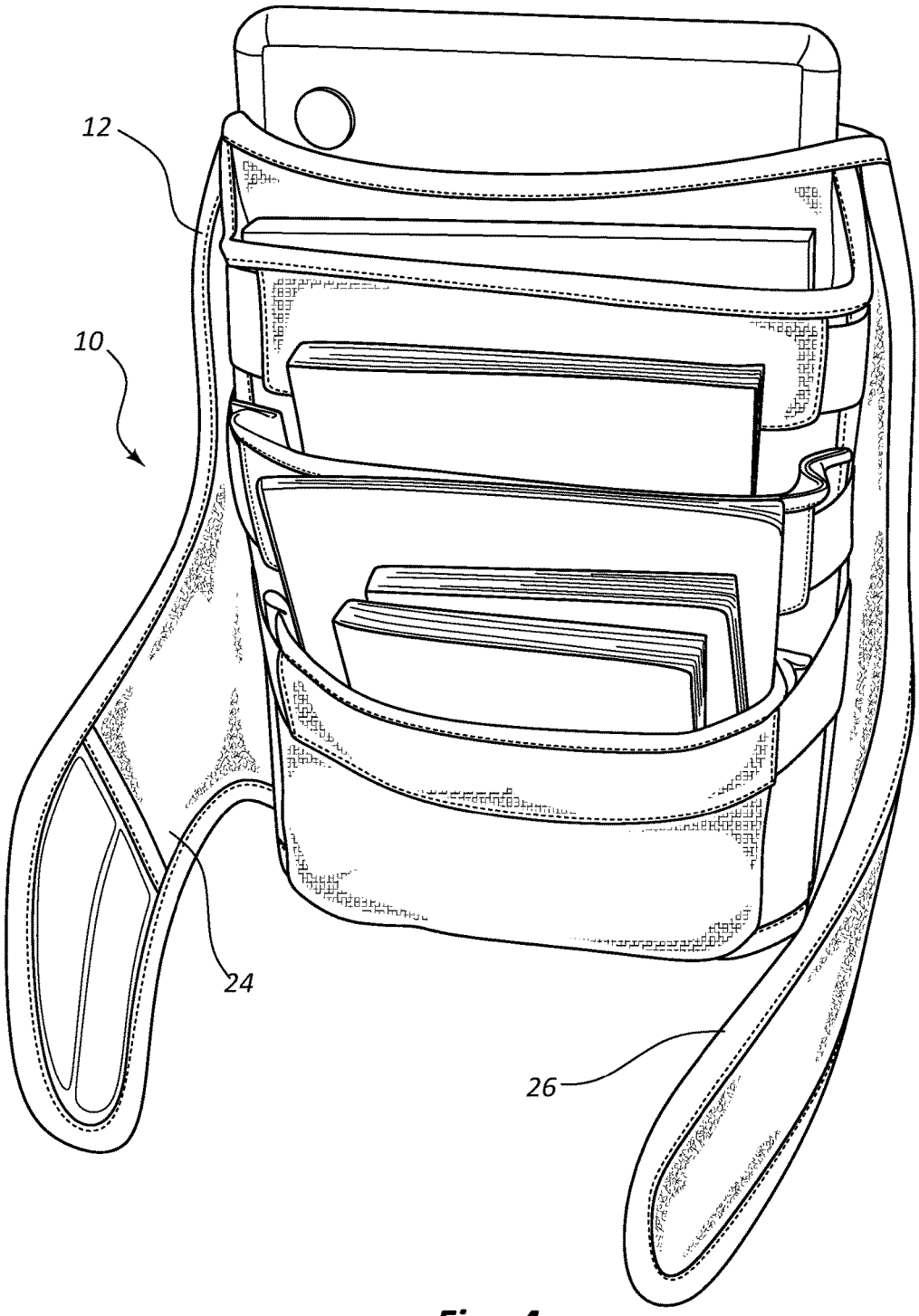
FIG. 4 illustrates a top view of the insert showing items stored in the pockets.
Figure 5:
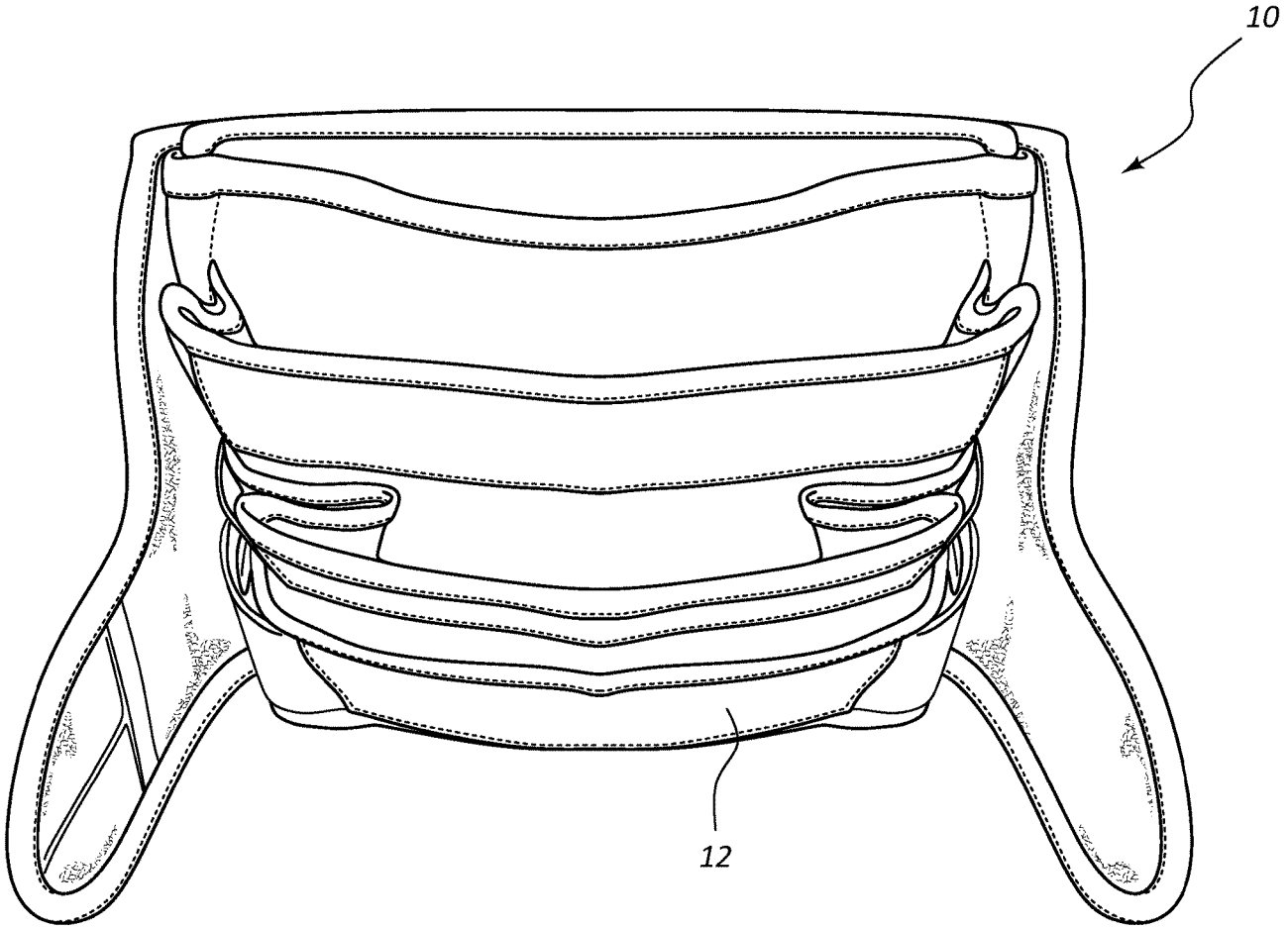
FIG. 5 illustrates a top view of the insert.
Figure 6:
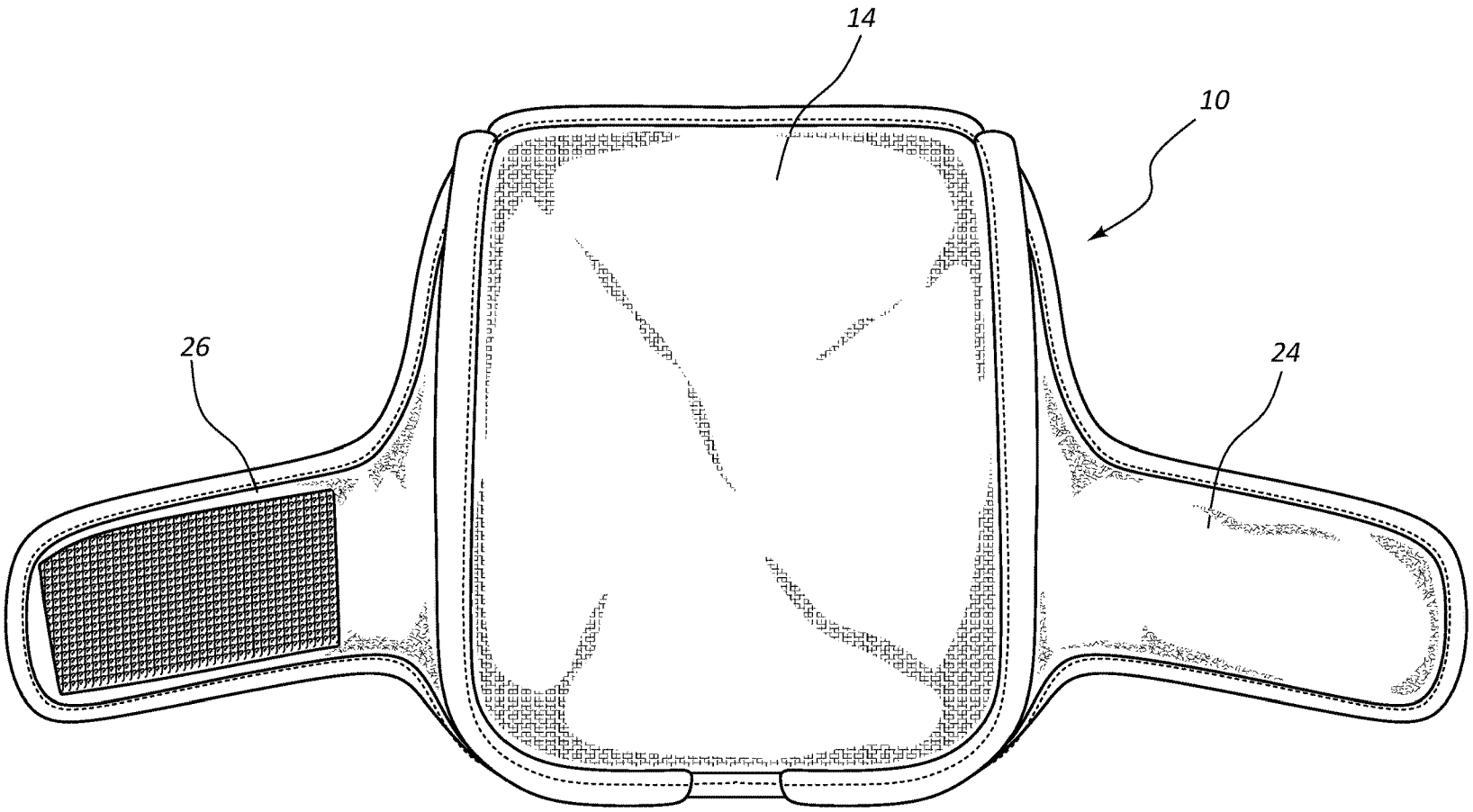
FIG. 6 illustrates a back view of the insert.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

A backpack is more comfortable when packed properly. A backpack insert 10 can be placed inside a backpack to help the user pack the back pack properly and distribute the weight of the contents evenly across the pack. The heaviest items can be placed as close to the user as possible by using the insert 10 while also keeping frequently used items easily accessible. This backpack insert 10 positions the items close to the wearer's back by providing sections that organize the contents. The insert 10 also provides pockets 12 for easily accessible storage compartments.

In a traditional school pack the heavy text books slump to the bottom outside corner of the pack, the most uncomfortable location for them, dragging the user off balance. The arrangement of the present backpack insert 10 includes nested, wedged shaped pockets 12 that organizes the books, keeping them as close to the wearer's center of gravity as possible.

FIGS. 1-6 illustrate the backpack insert 10 for a backpack having a series of pockets 12 to hold items, such as school supplies. The pockets 12 are placed along the insert 10 in a staggered arrangement. The insert 10 can be a free standing product that may be inserted into common sized day packs. The configuration of the insert 10 allows the insert 10 to support its own weight and that of the load placed in the pockets. The insert 10 is configured so that the center of gravity of the load is positioned close to the user's back. The insert 10 is arranged to place the load close to the suspension side of the pack, as close to the user as possible.

The insert 10 includes a backing plate 14 made of a rigid material, such as 0.060 ABS plastic frame sheet to frame in or support the pockets 12. This backing plate 14 can have the shape of an average pack back panel and can be made small enough that it can be slipped into a pack. The backing plate 14 provides the frame or structure to attach the series of pockets 12. A first pocket 16 is attached to the backing plate 14, for example, by sewing the first pocket 16 to the backing plate 14 to by other methods known in the art to attach a pocket to a support structure, such as an adhesive, rivets and the like. A second pocket 18 is also attached to the backing plate 14 in a staggered fashion in a similar manner as the first pocket 16. The second pocket 18 overlapping the first pocket 16 and staggered to provide a gap between the first pocket 16 and the second pocket 18. Other pockets 20 may also be attached to the backing plate 14 in a similar manner as the second pocket 18, also in a staggering arrangement.

A support beam may be added to the insert 10 to add structural support to the lower portion of the insert 10. The support beam, for example, can be a 1"×1/16" 6061 aluminum bar or stay. The support beam can be added to the frame sheet and sewn up the center line of the panel in a tunnel created by 2" wide nylon webbing, which acts like the spine of the pack. The support beam stiffens the frame sheet keeping it from collapsing under its own weight and transfers the weight of the books in the pockets to the foot of the insert 10. The stay can be 20" long with 3" of one end bent at a 90' angle.

The each of the pockets can include elastic side members 22. The side members 22, for example, can utilize 2" wide heavy duty elastic to apply compression to the pockets to aid in keeping the books in place. This creates a bending force on the pack or backing plate 14 that must be counteracted for the elastic to remain effective and the pockets to remain accessible. Two ¼ fiberglass rods, for example, can be slightly narrower in width than the frame sheet to stiffen the frame sheet side to side. Two fiberglass rods can be used. Each rod can be sewn into a tunnel made of 1.5" flat nylon webbing sewn to the frame sheet. The first tunnel is positioned at the top pocket, the second tunnel at the top of the bottom pocket. These tunnels can be position behind the aluminum stay, so that the fiberglass rods can use the aluminum stay as an anchor when they flex. The fiberglass rod tunnels overlap the aluminum stay tunnel, but be sure not to sew over the aluminum stay tunnel. The sewing in the middle can include a gap or portion not sewn to provide a distance for the aluminum stay tunnel.

A 3" bend at the bottom of the aluminum stay is used to transfer weight to a foot at the bottom of the insert. This foot is another piece of 0.060 plastic, faced on top with 500 denier fabric, rectangular in shape but with the corners rounded to mirror the shape of the floor of the pack, as big as can be made and still fit into the bottom of the average book bag. A piece of heavy 2" wide webbing is sewn to the back edge of this foot creating a hinge. The other side of this heavy webbing is sewn to the bottom back of the frame sheet with a gap left in the middle for the bent aluminum stay to come through. A piece of heavy webbing is sewn under the 3" section of aluminum stay. This arrangement allows weight to be transferred from the load tamer to the pack, it is one of the features that assists the load tamer to remain upright and properly positioned in the pack, and it distributes the weight over a large enough area to minimize wear on the pack floor.

The insert may include a first and second side member 24 and 26. The first and second side members 24, 26 are attached to the sides of the backing plate 14. The first and second members 24, 26 wrap around the pockets and attach to each other to form a ring 28. The ring 28 creates a space in the backpack that pushes the insert 10 into place up against the wearer. The first and second members 24, 26, for example, may be provided by the addition of arms of 0.060 plastic, 4"-5" wide and long enough to overlap each other when bent inside the body of the backpack. The arms can be faced on the outside with 500 denier fabric and hinged using 2" wide heavy webbing as on the foot, sewn to the edge of the backing plate 14, level with the top edge of the bottom pocket.

Figure 7:
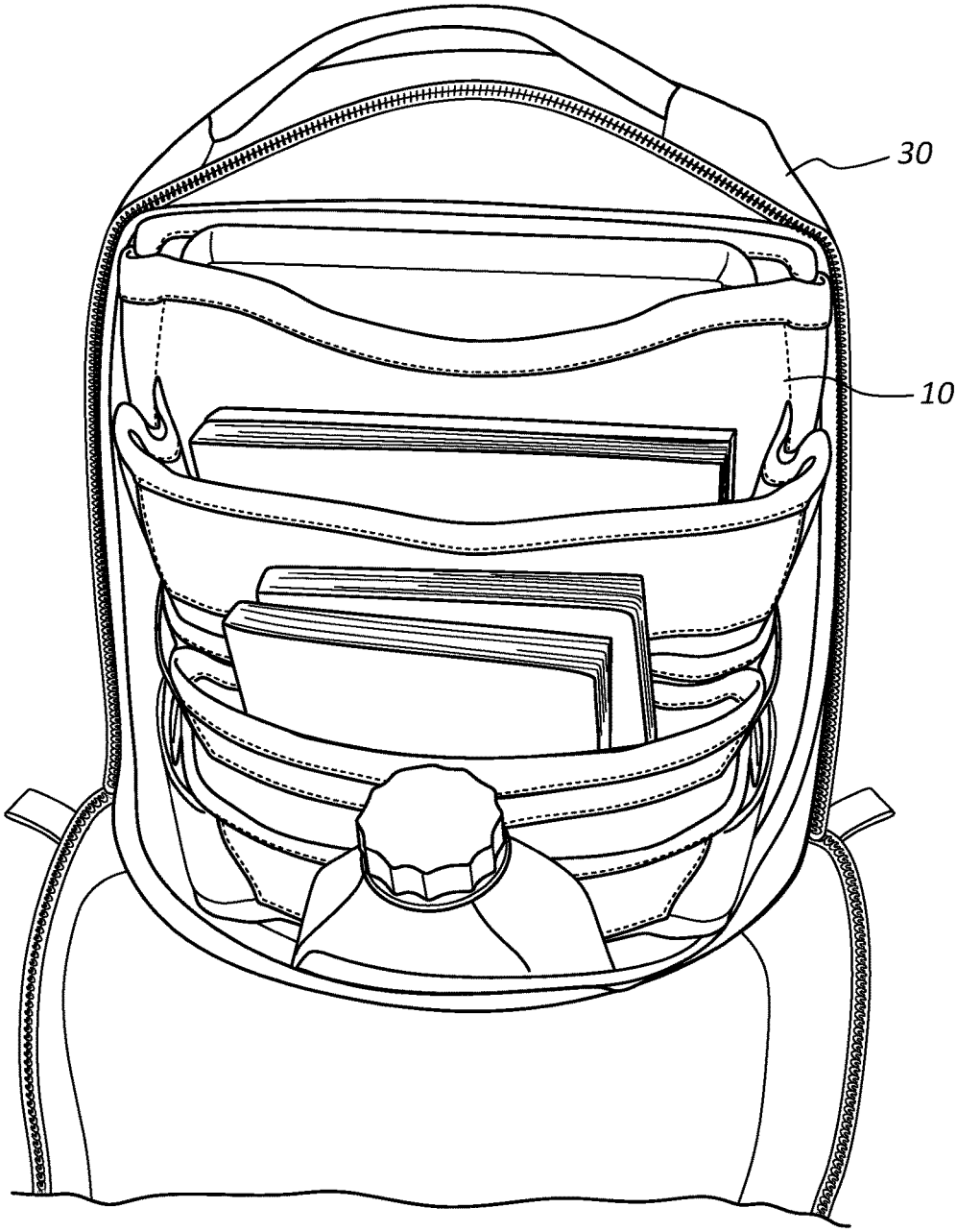
FIG. 7 illustrates a front view of the insert placed inside a backpack.
Figure 8:
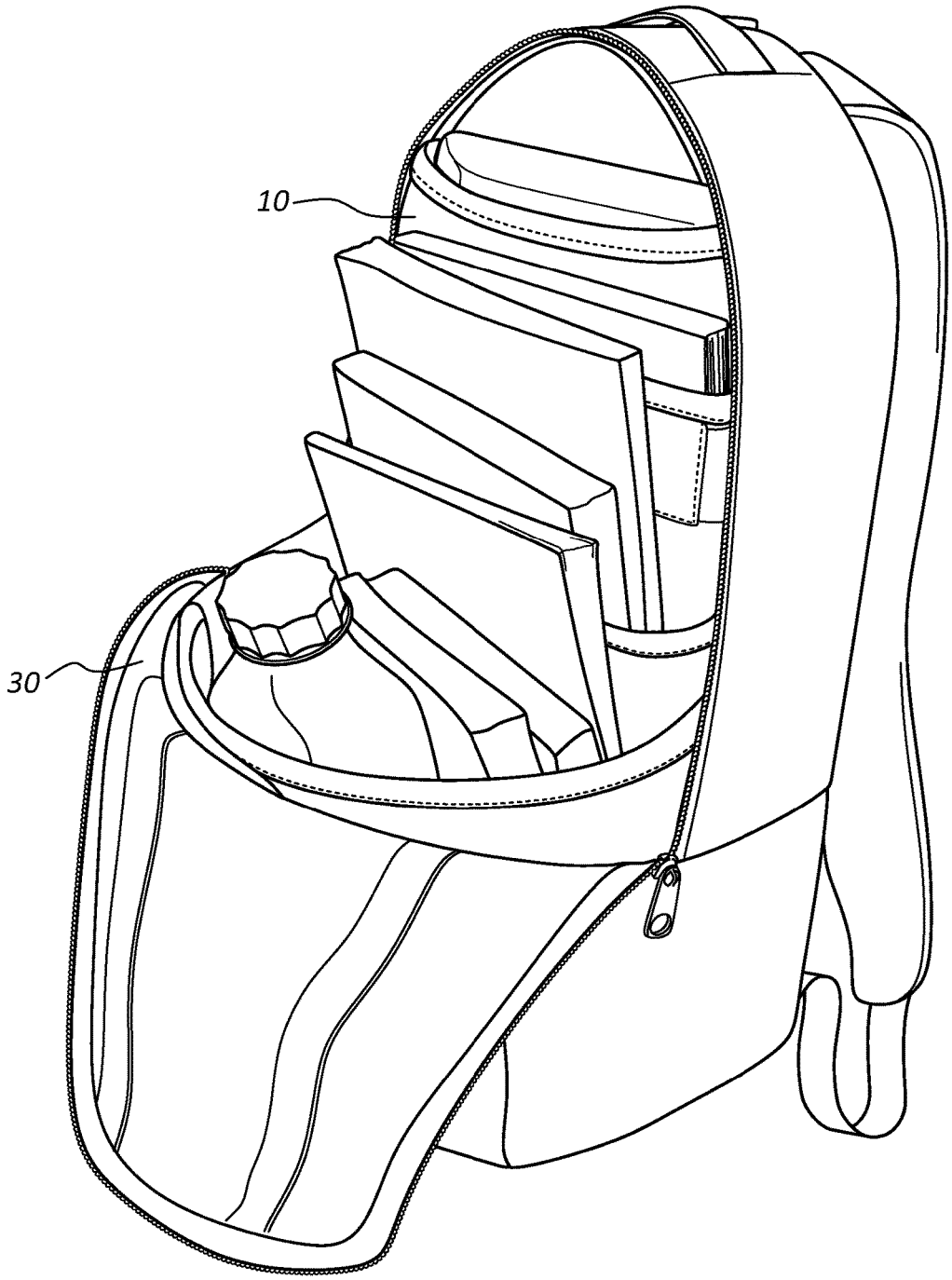
FIG. 8 illustrates a side view of the insert in a back pack.

As shown in FIGS. 7 and 8, the insert 10 is placed inside a backpack 30. This positioning can place this additional support as high in the pack 30 as possible without hindering access to the pockets or obstructing the zippered opening of the pack 30. A heavy webbing hinge can allow for a firm but flexible adjustment.

The first and second members 24, 26 can be attached together, for example, by using hook and loop fasteners or the like. A 3" wide hook and loop sheet, for example, can be sewn to rounded ends of the first and second members 24, 26. The first and second members 24, 26 can be adjusted to different inner circumferences' of packs. The insert 10 can be placed into the pack. The first and second members 24, 26 can be pushed open inside of the pack 30 until they are pressing firmly up against the interior of the pack 30.

The combination of the plastic frame sheet, aluminum stay, 2 fiberglass rods, stiffened foot and adjustable springy arms work together to keep the insert properly position in the back and give it the ability to efficiently transfer the weight of the books to the pack.

The generous opening of each pocket helps to hold large text books while the durable elastic and wedge shape of each compartment help prevent the load from shifting. The system includes a series of pockets sewn inside of a backpack to the interior panel closest to the wearer. More than three pockets cannot fit within the back panel profile of the average day pack. By sewing the pockets to the back panel the load is held as close as possible to the user for best comfort and control. By keeping the heaviest and densest items in a pack as close to the user, and centered around their center of gravity, is the most stable and comfortable location for those items. This design balances the competing needs of having a way to organize a pack full of books and things needed for school close at hand, while enabling those items to be held securely, as close to the wearer as possible. This is accomplished by having overlapping, expanding pockets sewn directly to the back panel, which allows a user to place about 3 to about 7 books or similar items, depending on size, in a position within the pack maximized for taming and controlling the load. Additionally, by sewing the pockets just to the back panel, the concept can be adopted by a greater variety of packs.

The pockets are similar in shape and material to reduce cost and increase efficiency in manufacture. By using a medium weight pack cloth fabric durability is enhanced. Each pocket is sized to be as wide as an average school backpack, for example, about 11.25 inches. The pocket is narrower at the bottom, for example, about 1.5 inches deep and wider at the top, for example, about 3.0 inches deep, these dimensions are built into the sides of the pocket. The side or edge of the pocket, for example, can be 6.75 inches long to assist in assembly of the backpack because, although the bottom edge of each pocket is below another pocket, the side edges including an elastic do not overlap, making final assembly and potential repairs easier.

The wedge shape allows the pockets to be sewn in a staggered fashion, one partly overlapping the other, with the top most pocket partly inside the middle pocket and the middle pocket partly inside the bottom pocket. By nesting the pockets, more books or items can be held closely to the user for better balance and comfort. There can be about 4.0 inches of overlap between each pocket. The wider opening allows books to be easily inserted, the tapered shape wedges the books in place and helps keep them from shifting.

The bottom corners 32, 34 of each of the pockets can include an opening 36, 38 on each side of the pocket to aid in the efficiency of manufacture and to eliminate a wear point at the corners 32, 34. For example, the corners 32, 34 can be cut at about a 45 degree angle. The bottom corners of the pockets have been left open. Removing the corner lets the pocket absorb books wider than its nominal width of about 1.5 inches without the stress and wear that would be imposed upon it by forcing a thick book deep into the pocket. As books move around inside of a pack the corners of the books abrade whatever they rub against, wearing it out this wear is most obvious at the bottom edges and corners of a pack. This design eliminates that potential wear point in the pocket.

The top corners of each pocket are positioned higher than the front edge by about 1.0 inch to reduce strain on the seam. This makes it harder to potentially tear the top corners of the pocket when inserting books and reduces strain on the front edge of the pocket. By creating a funnel like shape it makes putting books into the pocket easier.

An elastic strip about 2.0 inches by about 11.5 inches wide can be sewn through a tunnel across the front of each pocket. The wide elastic balances the competing needs of being able to get books in and out of the pocket easily, while firmly holding the books in place. The nearly 12 inches of elastic is long enough that it expands conveniently to allow the user to easily open the pocket to its full width but is then strong enough to close the pocket holding even the heaviest books snug to the back panel. The tunnel that the elastic travels through prevents it from shifting out of place, keeping the elastic positioned at the top of the pocket where it is most effective. High quality elastic ensures a long service life and sewing its ends into the main pack seams further help to reduce the chance of the elastic failing.

What is claimed is:

1. An insert for a backpack having walls, the insert comprising:

a backing plate;

a set of pockets including first pocket and a second pocket, the first pocket being attached to the backing plate, the second pocket attached to the backing plate adjacent to and overlapping the first pocket;

an elastic member, wherein the ends of the elastic member are attached to the sides of the backing plate and are configured to reinforce the set of pockets, the elastic member being disposed through a tunnel sewn across the front of the set of pockets, the ends of the elastic member being visible on both sides of the tunnel;

a first arm having a first end and a second end, the first end of the first arm attached to the right side of the backing plate; and a second arm having a first end and a second end, the first end of the second arm attached to the left side of the backing plate, wherein the second end of the first arm and the second end of the second arm are configured to wrap in front of the set of pockets to form a ring, the ring being rigid enough to substantially maintain its shape when forces press against the ring.

2. The insert according to claim 1, wherein the set of pockets comprises a plurality of pockets that are configured to nest inside each other and attach directly to the backing plate.

3. The insert according to claim 2, wherein the pockets have a wedge shape and are placed in a staggered arrangement.

4. The insert according to claim 1, wherein the set of pockets further comprises a third pocket, wherein the third pocket is attached to the backing plate adjacent to the second pocket and overlapping the first and second pockets.

5. The insert according to claim 1, wherein the set of pockets comprises pockets having openings in the bottom corners.

6. The insert according to claim 1, wherein the second end of the first arm and the second end of the second arm are attached together by hook and loop fasteners.

7. A backpack comprising the insert according to claim 1.

* * * * *